United States Patent [19]

Connelly

[11] Patent Number: 4,594,736

[45] Date of Patent: Jun. 17, 1986

[54] CURVED CLUTE-CUT GLOVE CONSTRUCTION

[75] Inventor: John R. Connelly, Deerfield, Ill.

[73] Assignee: Wells Lamont Corporation, Chicago, Ill.

[21] Appl. No.: 644,752

[22] Filed: Aug. 27, 1984

[51] Int. Cl.[4] ..... A41D 19/02

[52] U.S. Cl. ..... 2/163; 2/159; 2/169

[58] Field of Search ..... 2/163, 159, 161 R, 161 A, 2/169, 167

[56] References Cited

U.S. PATENT DOCUMENTS

| | | | |
|---|---|---|---|
| 6,352 | 3/1875 | Clute et al. | 2/169 |
| 754,160 | 3/1904 | Rate et al. | 2/169 |
| 1,037,946 | 9/1912 | Mahieu | 2/169 |
| 1,542,199 | 6/1925 | White | 2/169 X |
| 2,018,442 | 10/1935 | Elkus | 2/169 X |
| 2,343,220 | 2/1944 | Mason | 2/168 |
| 2,596,349 | 5/1952 | Thurlow et al. | 2/169 |
| 3,822,417 | 7/1974 | Lars-Jos | 2/169 |
| 4,245,357 | 1/1981 | Connelly | 2/163 |

FOREIGN PATENT DOCUMENTS

| | | | |
|---|---|---|---|
| 155568 | 3/1954 | Australia . | |
| 616134 | 3/1961 | Canada | 2/159 |
| 2346444 | 3/1975 | Fed. Rep. of Germany . | |

*Primary Examiner*—Werner H. Schroeder
*Assistant Examiner*—T. Graveline
*Attorney, Agent, or Firm*—Pennie & Edmonds

[57] ABSTRACT

Clute-cut glove construction is disclosed comprising in part a bottom hand or palm piece including bottom finger pieces, and a separate back piece for each of the bottom finger pieces. Each back piece further comprises a finger portion and a hand portion. Illustratively, each finger portion of each back piece is cut to have a longer longitudinal length than the associated bottom finger piece. Similarly, each finger portion of each back piece is cut to have a wider width than the associated bottom finger piece. Furthermore, the width of each back piece is uniquely cut to vary along the length of the finger and hand portions. During stitching of the back and bottom pieces, each portion of the bottom piece is stretched in order to align the edges of each bottom piece with the edges of its associated back piece. After the stitching operation, when the glove is no longer stretched, the fingers of the glove have the shape of fingers of a hand and curve inward toward the palm so that in use the glove can be moved to a clasping position without crumpling, creasing, or folding of the finger and palm sections of the glove.

5 Claims, 6 Drawing Figures

CURVED CLUTE-CUT GLOVE CONSTRUCTION

BACKGROUND

This invention relates to a Clute-cut glove construction that conforms to the natural curved configuration of a human hand that is in a relaxed state. In particular, in a relaxed state, the fingers of the glove curve inward towards the palm so that in use the glove can be moved to a clasping position without crumpling, creasing, or folding of the finger and palm sections of the glove.

Various methods of manufacturing gloves are known in the art. In one method gloves are manufactured in a flat form with the top and bottom sections of the glove being cut from a flat design and then subsequently being sewn together. A characteristic feature of gloves manufactured using this method is that the shape of the glove is not fashioned to the normal shape of the hand which, in a relaxed state, has fingers that are bent to some degree at an angle to the palm. The use of these gloves in the past have shown their shape to be acceptable where the gloves are made of light, flexible and more or less stretchable material that gradually adjusts to the shape of the hand in the course of wear. However, where the glove is made of stiff material, such as certain inexpensive grades of leather and certain course fabrics, or where the glove is made of rubberized material, the glove never forms itself to the shape of the hand even after considerable wear. As a result, these gloves are always difficult to bend, constrain the movement of the hand, are uncomfortable to wear, and are thus unsuitable for normal use.

In an attempt to improve upon these drawbacks, certain constructions have been devised which give the gloves a contour that is similar to the natural contour of the hand in a relaxed state. High fashion gloves, for example, use separate fourchette portions between the front and back parts of the fingers that are curved to have the shape of curved fingers that are in a relaxed state. These gloves require, however, a high degree of operator skill to sew the separate fourchettes together, and thus are expensive to manufacture. In another style, single piece rubber gloves are molded using well known molding procedures. These procedures are, however, not suitable for making cloth or leather gloves.

U.S. Pat. No. 4,245,357, which is incorporated herein by reference, has overcome to a large extent these limitations in a Gunn-cut glove construction. A Gunn-cut glove construction typically comprises three pieces of material that are stitched together to form the glove: a palm piece that includes the first and fourth finger portions of the glove, a middle piece that includes the second and third portions of the finger, and a back piece. In U.S. Pat. No. 4,245,357, the longitudinal distance of the front portion of the fingers of the glove is cut shorter than the longitudinal distance of the associated back portion. During the sewing operation, the front portion of each finger is stretched longitudinally to align with the back portion of that finger. The front and back portions are then sewn together. In order to accomplish this stretching on a commercial-scale, the back portion of the finger is fed to the stitching needle at a faster rate of speed than its associated front portion. When the glove is allowed to relax from the stretching operation, the shape of the fingers and thumb portions of the glove is identical to the shape of the curved fingers and the thumb of a hand that is in a relaxed state.

In U.S. Pat. No. 4,245,357, the palm portion which extends between the joint line of the fingers and the joint line of the thumb joint is also shorter than the back portion which extends between the same joint lines. These front and back portions are aligned during stitching in a manner that is similar to the one used in the stitching of the finger portions. As a result, the palm portion of the glove also has a curved shape which conforms to the shape of the palm of a hand that is in a relaxed state.

It is the curvature of the finger, thumb, and palm portions of the glove when the glove is in a relaxed state that permits the glove to be moved to a clasping position without crumpling, creasing, or folding at those portions. However, to further prevent crumpling, creasing, and folding at these portions, the base edge of the front finger portions of the second and third fingers of the middle piece (i.e., the edge that adjoins the palm piece) is cut to have a concave edge which is sewn to a complementary concave edge in the palm piece. Additionally, after the portions of the glove have been sewn together, the glove may be placed over a heating element which has the shape of a hand that is in a relaxed state. By heating the gloves over the mold, the curvature of the glove is further conformed to the shape of a hand that is in a relaxed state.

Although U.S. Pat. No. 4,245,357 greatly improves the clasping characteristics of a Gunn-cut construction glove it does not address certain problems that other glove constructions, such as a Clute-cut glove construction, create by their unique cuts when the glove is in use.

It is an object of this invention to address these problems in the Clute-cut glove construction with a Clute-cut glove construction which does not form creases and folds in the palm portion of the glove or otherwise constrains the movement of the hand when the hand is in use. Unlike Clute-cut glove constructions in the prior art, this invention minimizes restricted circulation of blood in the hands and wear on the knuckles, the ligaments, and the muscles that Clute-cut glove constructions usually create on the hand when the hand is in use. As a result, this invention provides a clute-type glove which is more fitted to the natural motions of the hands than any prior art Clute-cut glove construction.

SUMMARY OF THE INVENTION

In the present invention, I have devised a glove construction for a Clute-type glove which conforms to the natural curved configuration of a human hand that is in a relaxed state. In particular, in a relaxed state, the fingers of the glove curve inward towards tne palm so that in use the glove can be moved to a clasping position without crumpling, creasing, or folding of the finger palm sections of the glove.

In accordance with my invention, the glove construction comprises in part a bottom hand or palm piece including bottom finger pieces and a separate back piece for each of the bottom finger pieces. Each back piece for each of the fingers further comprises a finger portion and a hand portion. The back and bottom pieces are sewn together around their peripheries to form the glove and to this extent, the construction is similar to a conventional Clute-cut glove. However, unlike the prior art, my invention imparts a curved configuration both along the length and across the width of each finger of the glove. Illustratively, each finger portion of each back piece is cut to have a longer longitudinal length than the associated bottom finger piece. Similarly, each finger portion of each back piece is cut to have a wider width than the associated bottom finger piece.

During stitching of the back and bottom pieces each portion of the bottom piece is stretched in order to align the edges of each bottom piece with the edges of its associated back piece. In the commercial manufacture of these gloves, this stretching can be accomplished by using a compound feed sewing machine which feeds a back finger portion to the stitching needle at a faster rate of speed than its associated back finger piece while the two portions are stitched together. After the stitching operation, when the glove is no longer stretched, the longer length of each back piece relative to its associated bottom piece imparts a curved configuration along each finger of the glove. Similarly, the wider width of each back piece relative to its associated bottom piece imparts a curved configuration across the width of each finger of the glove.

In order to tailor the pieces of the glove to conform more closely to the fingers of the hand, the width of each back piece is uniquely cut to vary along the length of the finger portion. In particular, the base of each finger portion is wider than the end of the finger. When the glove is assembled, these unique cuts permit the glove to be moved to a clasping position without crumpling, creasing, or folding of the finger and palm sections of the glove.

After the separate parts of the glove have been sewn together, the glove may be placed over a heating element that has the shape of a hand in a relaxed state. By heating the element, the curvature of the glove may be further conformed to the shape of a hand that is in a relaxed state.

DESCRIPTION OF PREFERRED EMBODIMENT

Figure 1:
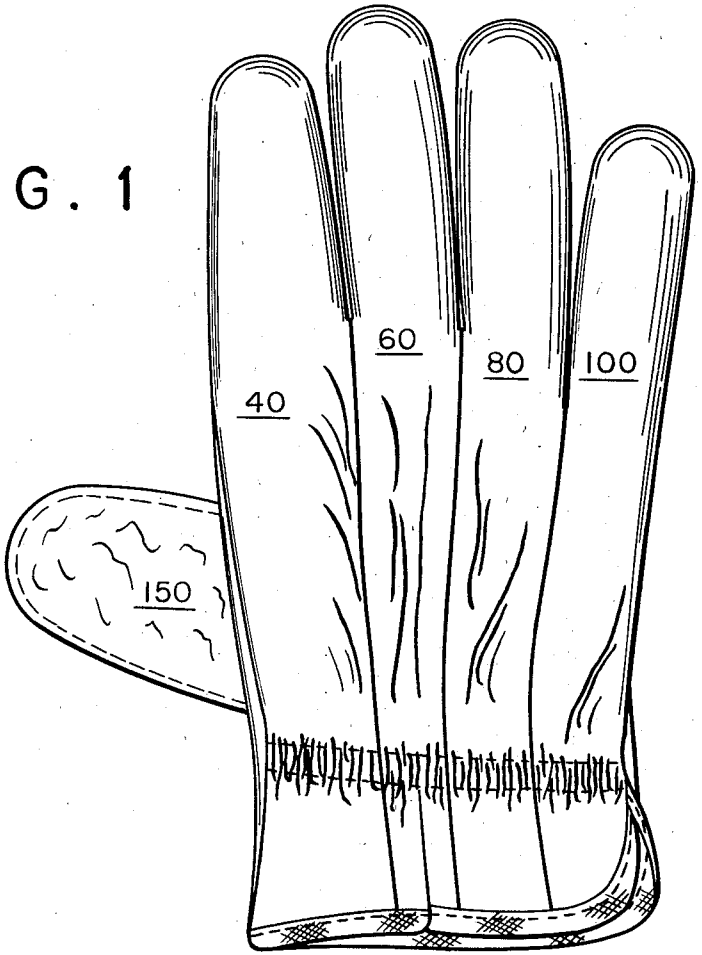
FIG. 1 is a plan view of the back side of a Clute type glove constructed according to the invention.

Referring to FIG. 1, the back side of a Clute-cut glove construction of the present invention is illustrated comprising a bottom hand piece (not shown), a thumb piece 150, and separate back pieces 40, 60, 80 and 100 for each of the fingers with adjacent back pieces being joined together along part of their lengths to form a back side of the hand portion of the glove.

Figure 2:
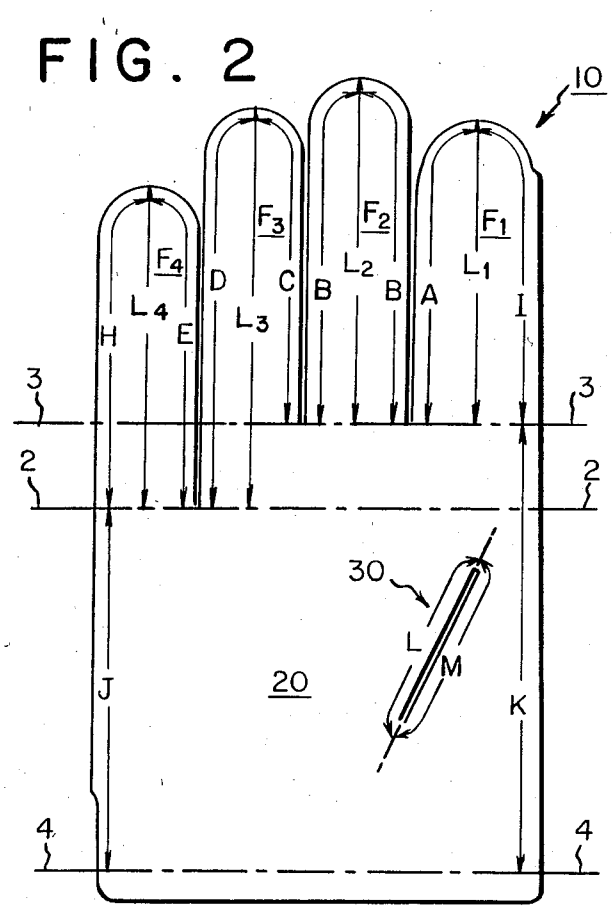
FIG. 2 is a plan view of bottom or palm piece of the glove of FIG. 1.

FIG. 2 shows a bottom hand piece 10 comprising bottom finger pieces F1, F2, F3 and F4, palm piece 20, and thumb chisel 30. In accordance with the Clute-cut construction, the bottom hand piece shown in FIG. 2 is cut from a single piece of leather in order to eliminate seams that may produce irritations or decreased sensitivity to the palm of the hand when the hand is in use. The bottom finger pieces F1, F2, F3 and F4 correspond to the index finger, the middle finger, the ring finger, and the little finger of a human hand. As shown in FIG. 2, finger pieces F1 and F2 have a length $L_1$ and $L_2$, respectively, which are measured from the end of the finger pieces to the finger joint line 3. Finger pieces $F_3$ and $F_4$ have a length $L_3$ and $L_4$, respectively, which are measured from the end of the finger pieces to the finger joint line 2.

FIG. 2 also shows the critical sewing distances of bottom hand piece—namely, sewing distances I and A from finger joint line 3 to the end of index finger $F_1$, sewing distances B from finger joint line 3 to the end of middle finger $F_2$, sewing distance C from finger joint line 3 to the end of ring finger $F_3$, sewing distance D from finger joint line 2 to the end of ring finger $F_3$, sewing distances E and H from joint line 2 to the end of finger $F_4$ and finally, sewing distance J which extends between joint line 2 and wrist line 4 and sewing distance K which extends between joint line 3 and wrist line 4. Additionally, sewing distances L and M extend along the edges of thumb chisel 30.

Figure 3:
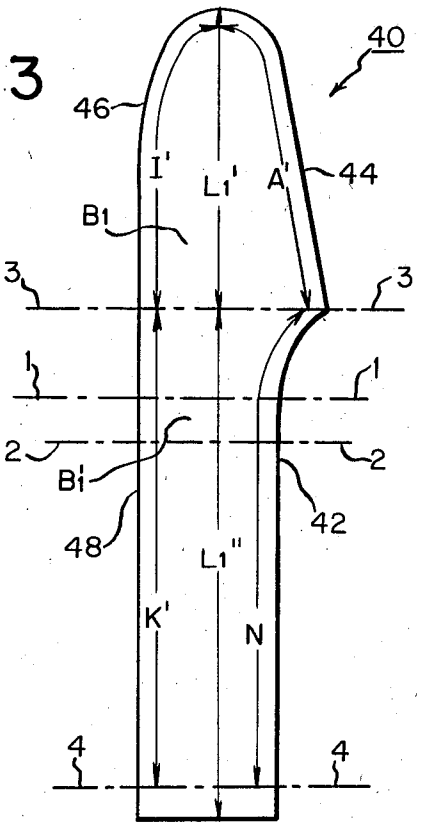
FIG. 3 is a plan view of a back piece for the index finger of the glove of FIG. 1.

FIG. 3 shows a back piece 40 for an index finger of a glove that is constructed according to the invention comprising a finger portion $B_1$ and a hand portion $B'_1$. As shown in FIG. 3, finger portion $B_1$ has a length $L'_1$ which is measured from finger joint line 3 to the end of the finger portion and hand portion $B'_1$ has a length $L''_1$ which is measured from finger joint line 3 to a point beyond wrist line 4.

Back piece 40 for the index finger is cut from a single piece of material. The characteristic feature of this inventive cut is that the dimensions of this back piece are greater than the corresponding dimensions of associated finger $F_1$ piece of bottom piece 10. With more material both along and across finger portion $B_1$ of back piece 40 than along and across the corresponding finger piece $F_1$ of bottom piece 10, after the two pieces are sewn together, the index finger of the glove advantageously conforms to the natural curvature of the index finger of the hand when it is in a relaxed state—that is, it is bent inward toward the palm of the hand.

An additional characteristic feature of this inventive cut is that the edges of this piece are cut so that, when the glove is assembled, they advantageously permit the finger of the glove to conform to the shape of an index finger. To illustrate, edge 42, which extends between joint line 3 and wrist line 4 along the middle finger side of hand portion $B'_1$ is cut to have a curved configuration between joint line 3 and joint line 1. In addition, edge 48 extends linearly between joint line 3 and wrist line 4 so that it is aligned with the linear bone member of the hand which is connected between the wrist and the knuckle of the index finger. When the glove is assembled, the part of the index finger represented by these cuts contours the shape of the same finger between the second joint and the base of the index finger. Additionally, edges 44 and 46, which extend between joint Line 3 and the end of the finger portion $B_1$—along the middle finger side and thumb side, respectively, of finger portion $B_1$—are cut to have a curved configuration. When the glove is assembled, the part of the index finger represented by these cuts contours the shape of the same finger between the second joint and end of the index finger.

FIG. 3 also shows critical sewing distances of back piece 40 of this invention—namely, sewing distances I' and A' which extend from finger joint line 3 to the end of finger portion $B_1$, and sewing distances K' and N which extend from finger joint line 3 to wrist line 4.

Figure 4:
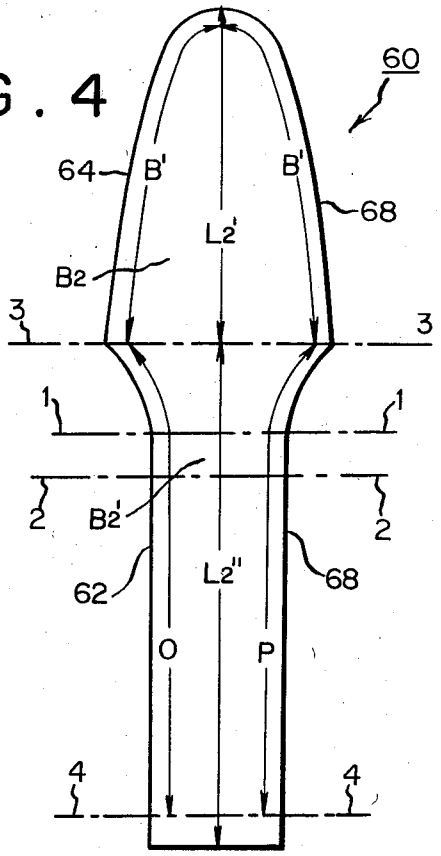
FIG. 4 is a plan view of a back piece for the middle finger of the glove of FIG. 1.

FIG. 4 shows a back piece 60 for a middle finger of a glove that is constructed according to the invention comprising a finger portion $B_2$ and hand portion $B_2'$. As shown in FIG. 4, finger portion $B_2$ has a length $L_2'$ which is measured from finger joint line 3 to the end of the finger portion and hand portion $B_2'$ has a length $L'_2$ which is measured from finger joint line 3 to a point beyond wrist line 4.

Back piece 60 for the middle finger is cut from a single piece of material. The characteristic feature is that the dimensions of this back piece are greater then the corresponding dimensions of associated finger piece $F_2$ of bottom piece 10. With more material both along and across finger portion $B_2$ of back piece 60 than along and across the corresponding finger piece F of bottom piece 10, after the two pieces are sewn together, the middle finger of the glove advantageously conforms to the natural curvature of the middle finger of the hand when it is in a relaxed state—that is, it is bent inward toward the palm of the hand.

An additional characteristic feature of this inventive cut is that the edges of this piece are cut so that, when the above is assembled, they advantageously permit the finger of the glove to conform to the shape of a middle finger. To illustrate, cuts 62 and 68, which extend between joint line 3 and wrist line 4 along the index finger side and fourth finger side, respectively, of finger portion $B'_2$, are cut to have a curved edge between joint lines 3 and 1. When the glove is assembled, the part of the middle finger represented by these cuts contours the shape of the same finger between the second joint and base of the middle finger. Additionally, cuts 64 and 68, which extend between joint lines 3 and the end of the finger portion $B_2$ along the index finger side and fourth finger side, respectively, of finger portion $B_2$ are cut to have a curved edge. When the glove is assembled, the part of the middle finger represented by these cuts contours the shape of the same finger between the second joint and end of the middle finger.

FIG. 4 also shows critical sewing distances of the backpiece 60 of this invention—namely, sewing distances B' from finger joint line 3 to the end of finger portion $B_2$ and sewing distances O and P from joint line 3 to wrist line 4.

Figure 5:
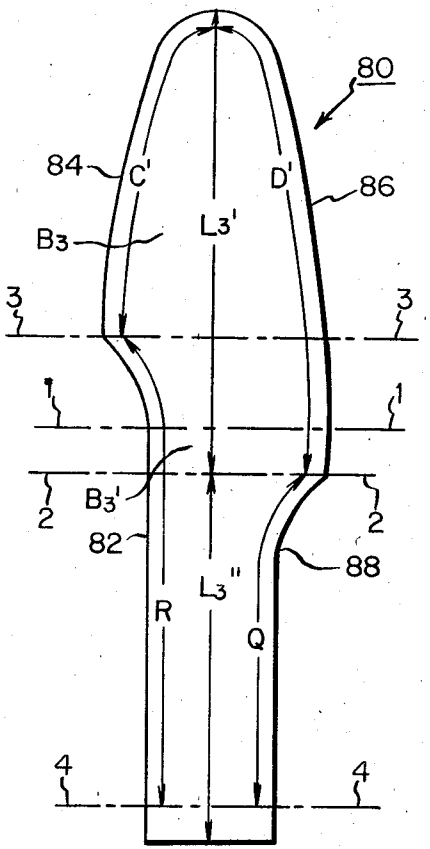
FIG. 5 is a plan view of a back piece for the fourth or ring finger of the glove of FIG. 1; and, FIG. 6 is a plan view of a back piece for the little finger of the glove of FIG. 1.

FIG. 5 shows a back piece 80 for a ring finger of a glove that is constructed according to the invention comprising a finger portion $B_3$ and a hand portion $B_3'$. As shown in FIG. 5, finger portion $B_3$ has a length $L'_3$ which is measured from finger joint line 2 to the end of the finger portion and hand portion $B_3'$ has a length $L_3''$ which is measured from finger joint line 2 to a point beyond wrist line 4.

Back piece 80 for the ring finger is cut from a single piece of material. The characteristic feature of this cut is that the dimensions of this back piece are greater then the corresponding dimensions of associated finger piece $F_3$ of bottom piece 10. With more material both along and across finger portion $B_3$ of back piece 80 than along and across the corresponding finger piece $F_3$ of bottom piece 10, after the two pieces are sewn together, the ring finger of the glove advantageously conforms to the natural curvature of the fourth finger of the hand when it is in a relaxed state—that is, bent inward toward the palm of the hand.

An additional characteristic feature of this inventive cut is that the edges of this piece are cut so that, when the glove is assembled, they advantageously permit the finger of the glove to conform to the shape of a ring finger of a hand. To illustrate, edge 82, which extends between joint line 3 and wrist line 4 along the middle finger side of finger portion $B_3$ is cut to have a curved edge between joint line 2 and joint line 3. In addition, edge 88, which extends between joint line 2 and wrist line 4 along the little finger side of hand portion $B_3'$, is cut to have a curved edge between joint line 2 and joint line 1. When the glove is assembled, the part of the ring finger represented by these cuts contours the shape of the same finger between the second joint and base of the ring finger. Also extending along the same side of the finger as edge 82 is edge 84 which is also curved. In addition, also extending along the same side of the finger as edge 88 is edge 86 which also is curved. When the glove is assembled, the part of the ring finger represented by these edge contours the shape of the ring finger between the second joint and the end of the fourth finger.

It will be apparent to those skilled in the art that both joint lines 2 and 3 are located near the base of the ring finger. One characteristic feature of the inventive cut for back piece 80 is that when assembled, the ring finger of the glove is provided with two joint lines. Joint line 3 represents the joint line of the index and middle fingers while joint line 2 represents the joint line of the little finger. Because the ring finger of the glove is provided with both joint lines, when the glove is moved to a clasping position, these joint lines advantageously minimize the forces that normally occur in a glove along the base of the ring finger due to the different joint lines of the middle and little fingers of the hand.

FIG. 5 also shows critical sewing distances of back piece 80 of this invention—namely, sewing distances D' from finger joint line 2 to the end of the ring finger $B_3$, sewing distance C' from finger joint line 3 to the end of the fourth finger portion $B_3$, sewing distance Q from joint line 2 to wrist line 4, and sewing distance R from joint line 3 to wrist line 4.

Figure 6:
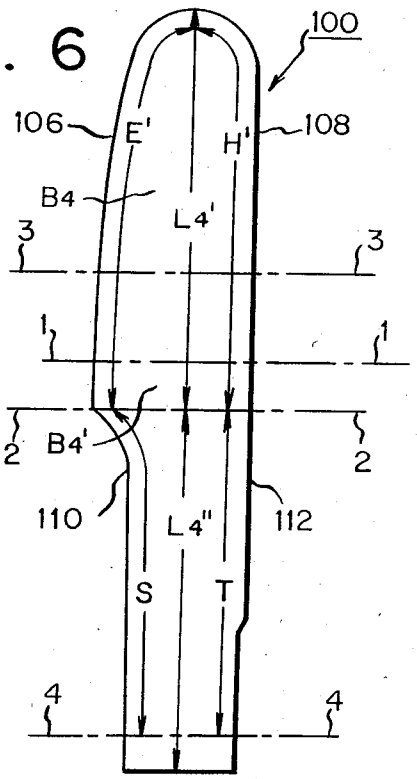

FIG. 6 shows a back piece 100 for a little finger of a glove that is constructed according to the invention comprising a finger portion $B_4$ and hand $B_4'$. As shown in FIG. 6, finger portion $B_4$ has a length $L_4'$ which is measured from finger joint line 2 to the end of the finger portion and hand portion $B_4'$ has a length $L_4''$ which is measured from finger joint line 2 to a point beyond wrist line 4.

Back piece 100 for the little finger is cut from a single piece of material. The characteristic feature is that the dimensions of this back piece are greater than the corresponding dimensions of the associated finger piece $F_4$ of bottom piece 10. With more material both along and across finger portion $B_4$ of back piece 10 than along and across the corresponding finger piece $F_4$ of bottom piece 10, after the two pieces are sewn together, the little finger of the glove advantageously conforms to the natural curvature of the little finger of the hand when it is in a relaxed state—that is, it is bent inward toward the palm of the hand.

An additional characteristic feature of this inventive cut is that the edges of this piece are cut so that, when the glove is assembled, they advantageously permit the finger of the glove to conform to the shape of a little finger. To illustrate, cuts 106 and 108, which extend along the ring finger side and outer side, respectively, of the little finger between joint line 2 and the end of little finger $B_4$, are cut to have a curved edge between joint line 2 and the end of little finger $B_4$. When the glove is assembled, the part of the little finger represented by these cuts contours the shape of the same finger between the second joint and the end of the little finger. Cut 110 which extends along the ring finger side of the little finger has a curved edge while cut 112 extending along the outer side of the little finger has a linear edge. When the glove is assembled, the part of the little finger represented by these cuts contours the shape of the same finger between the second joint and base of the little finger.

FIG. 6 also shows the critical sewing distances of back piece 100 of this invention—namely, sewing distances E′ and H″ from joint line 2 to the end of the little finger, and sewing distances S and T from joint line 2 to wrist line 4.

To construct a glove according to this invention, the finger portions of the back pieces of the index finger, the middle finger, the ring finger, and the little finger, which are shown in FIGS. 3, 4, 5, and 6, respectively, are positioned above the finger pieces of bottom piece 10 shown in FIG. 2. In particular, back piece 40 of the index finger is positioned above finger piece $F_1$ of bottom piece 10 so that seam distances A′, I′ and K′ of the back piece are near seam distances A, I, and K respectively, of the bottom piece. Similarly, back piece 60 of the middle finger is positioned above finger r piece $F_2$ of bottom piece 10 so that seam distances B′ of back piece 80 are near seam distances B of the bottom piece. Likewise, back piece 80 of the ring finger is positioned above finger piece $F_3$ of bottom piece 10 so that seam distances C′ and D′ of the back piece are near seam distances C and D of the bottom piece. Finally, back piece 100 of the little finger is positioned above finger piece $F_4$ of bottom piece 10 so that seam distances H′ and E′, of the back piece are near seam distances H and E of the bottom piece.

Before the back and bottom pieces are sewn together, each of the seam distances in the finger piece of the bottom piece are brought into alignment with the associated seam distance in the corresponding finger portion of the back piece by applying a stretching force to each bottom piece. In the alternative, the seam distances can be brought into alignment by feeding each finger portion of each back piece to the sewing needle at a faster rate than the corresponding finger pieces of the bottom piece. After the seam distances are aligned, the bottom and back pieces are sewn together along these sewing distances. The sewing distances between the hand portions of adjacent back pieces are then sewn together using conventional sewing techniques. To illustrate this latter sewing operation, seam distance N of the index finger is sewn to seam distance 0 of the middle finger; seam distance P of the middle finger is sewn to seam distance R of the ring finger; and seam distance Q of this finger is sewn to seam distance S of the little finger. Finally, seam distance T of the little finger is sewn to seam distance J of the bottom piece 10 and seam distance K′ of the index finger is sewn to seam distance K of bottom piece 10.

To complete the glove construction, two thumb pieces, a front and back piece, are each cut to have three sides which contour a thumb profile and a fourth side which has a straight edge—the shape of each side being described in detail in U.S. Pat. No. 4,123,803. The three sides of the two thumb pieces are sewn together and the straight edge of each piece is sewn to sewing distances L and M surrounding thumb chisel 30 shown in FIG. 2. The thumb pieces are sewn to bottom piece 10 in a manner that points the thumb piece away from the wrist and toward the fingers of the hand.

Once the pieces of the glove are sewn together the stretching force on the finger portions of the bottom pieces are removed. Absent this stretching force, the shorter dimensions of the finger pieces of the bottom piece relative to the finger portions of the back pieces cause the glove construction to curve inward toward the palm of the hands. Advantageously, the shorter dimensions of the finger pieces of the bottom piece with respect to the dimensions of the associated finger portions of the back pieces together with the unique cuts of the back pieces cause the clute cut glove construction to conform to the natural configuration of a human hand that is in a relaxed state.

I claim:

1. A Clute-cut glove construction having in part a bottom hand piece including an index, middle, fourth and little finger pieces of stretchable material and joined to a palm piece, and a separate back piece for each of the said finger pieces with each back piece having a finger portion and a hand portion, characterized in that said finger portion of each of the back pieces has a length that is longer than the unstretched length of its corresponding finger piece of said bottom hand piece and a width that is wider than the unstretched width of its corresponding finger piece of said bottom hand piece, the finger pieces of said bottom hand piece being connected to the corresponding finger portions of each of the back pieces with their stretched length and width distances equal to the associated unstretched length and width distances of the corresponding finger portions of each of the back pieces, whereby said glove construction will have a curved configuration corresponding to that of a hand in a relaxed state after the finger portions of the back pieces have been sewn to the corresponding finger pieces.

2. The glove construction of claim 1 wherein said finger portion of said back piece for the index finger has a first side adjacent the thumb that has a first curved edge extending from a point corresponding to the second digit of the finger of a wearer to an end of said finger, and a second side adjacent the middle finger that has a second curved edge extending from said point of said finger portion to an end of said finger, and said hand portion has a curved edge along a side of said back piece adjacent to the middle finger and has a linear edge along a side of said back piece adjacent the thumb, both said edges extending from said point of finger portion to an end of the hand portion opposite the finger portion.

3. The glove construction of claim 1 wherein said finger portion of said back piece for the middle finger has on both index and fourth finger sides of the finger portion a curved edge extending from a point corresponding to a second digit of the middle finger of a wearer to an end of said finger portion and said hand portion has on both index and fourth finger sides of the hand portion a curved edge extending from said point of the middle finger portion to an end of the hand portion opposite the finger portion.

4. The glove construction of claim 1 wherein said finger portion of said back piece for the fourth finger has a first curved edge extending along the middle finger side of the finger portion from a point corresponding to a second digit of the fourth finger of a wearer to the end of said finger portion, has a second curved edge extending along the little finger side of the finger from below said second point to the end of the finger portion;

and said hand portion of said back piece has a third curved edge extending along the middle finger side of the finger from said point to the end of the hand portion opposite the finger portion, and has a fourth curved edge extending from below said point to the end of the hand portion opposite the finger portion.

5. The glove construction of claim 1 wherein said finger portion of said back piece for the little finger has a first side adjacent the fourth finger that has a first curved edge extending from a point corresponding to a second digit of the little finger of a wearer to an end of said finger and a second opposite side that has a second curved edge extending from said point of said finger to the end of the finger and said hand portion has a curved edge along a side of said back piece adjacent to the fourth finger and a linear edge along its opposite side, both said edges extending from said point of the little finger portion to an end of the hand portion opposite the finger portion.

* * * * *